United States Patent [19]

Yueh

[11] Patent Number: 4,783,744

[45] Date of Patent: Nov. 8, 1988

[54] SELF-ADAPTIVE IRU CORRECTION LOOP DESIGN INTERFACING WITH THE TARGET STATE ESTIMATOR FOR MULTI-MODE TERMINAL HANDOFF

[75] Inventor: William R. Yueh, Fullerton, Calif.

[73] Assignee: General Dynamics, Pomona Division, Pomona, Calif.

[21] Appl. No.: 939,509

[22] Filed: Dec. 8, 1986

[51] Int. Cl.[4] ..... G06F 15/50

[52] U.S. Cl. ..... 364/454; 364/462; 364/571.01; 235/412; 342/62; 244/3.2

[58] Field of Search ..... 364/423, 443, 453, 454, 364/457, 571, 462; 244/3.2; 342/62, 77; 235/412, 413

[56] References Cited

U.S. PATENT DOCUMENTS

| | | | |
|---|---|---|---|
| 2,914,763 | 11/1953 | Greenwood, Jr. et al. | 244/3.2 |
| 3,456,255 | 11/1967 | Wieland et al. | 244/3.2 |
| 3,702,477 | 11/1972 | Brown | 364/453 |
| 3,763,358 | 10/1973 | Cargille | 364/453 |
| 3,790,766 | 2/1974 | Brown | 364/453 |
| 3,821,738 | 6/1974 | Quesinberry et al. | 342/77 |
| 3,940,597 | 4/1976 | DiMatteo | 364/571 |
| 3,982,246 | 9/1976 | Lubar | 364/458 |
| 4,032,759 | 6/1977 | Danik | 364/453 |
| 4,128,837 | 12/1978 | Page | 235/412 |
| 4,179,696 | 12/1979 | Quesinberry et al. | 342/75 |
| 4,224,507 | 9/1980 | Gendreu | 235/412 |
| 4,494,202 | 1/1985 | Yueh | 235/412 |
| 4,589,610 | 5/1986 | Schmidt | 342/62 |

OTHER PUBLICATIONS

Optimum Integration of Aircraft Navigation Systems, William Zimmerman, IEEE Transactions on Aerospace and Electronic Systems, vol. AES-5, No. 5 (article).

Applied Optimal Estimation by the Technical Staff of the Analytic Sciences Corporation, 1974, Chapter 7, "Suboptimal Filter Design and Sensitivity Analysis" (reference text).

*Primary Examiner*—Gary Chin

*Attorney, Agent, or Firm*—Neil F. Martin; Edward B. Johnson

[57] ABSTRACT

A method and apparatus for identifying inertial reference unit (IRU) errors in a guided missile employing a multi-mode guidance system and constructing correction terms to recover the missile true position. Discrepancy parameters are introduced to indicate misalignment between missile and launching platform (or ship) inertial frames where the missile onboard executive computer simultaneously processes the data provided from missile onboard sensors and target relevant data uplinked from the launching platform. The discrepancy parameters are employed to construct correction factors used to reduce the discrepancies. This updated missile configuration is then coupled with the target state estimator outputs to reconstruct smoothed line-of-sight (LOS) angles for terminal homing engagement.

11 Claims, 7 Drawing Sheets

SELF-ADAPTIVE IRU CORRECTION LOOP DESIGN INTERFACING WITH THE TARGET STATE ESTIMATOR FOR MULTI-MODE TERMINAL HANDOFF

GOVERNMENT CONTRACT

The Government has rights in this invention pursuant to Contract No. N00024-80-C-5371, awarded by the U.S. Navy.

FIELD OF THE INVENTION

This invention relates generally to guidance systems for guided missiles and more particularly concerns a self-adaptive IRU correction loop design in a multi-mode guidance system for determining missile true position to facilitate obtaining smoothed LOS angle estimates.

BACKGROUND OF THE INVENTION

Target tracking systems employing Kalman estimators for predicting the position of moving targets are frequently used for purposes of controlling intercept missiles and aircraft. In a typical radar tracking system, pulses are transmitted through an antenna at a predetermined repetition rate toward a target and the pulses are reflected from the target back to the antenna. The time of reception and the doppler shift of the pulses, together with the pointing angles of the airborne antenna, the time history of angular orientation and of the velocity vector of the skin tracking aircraft or missile are processed by a signal processor to generate signals that represent range, radial velocity or range rate, and the elevation and azimuth angles to the target.

In the mechanization of such a system, a high-speed digital computer may be used which operates on the measured input signals within a specified time frame. Calculations are made in accordance with the computer algorithm and the results of each calculation is sent to the antenna for controlling the antenna position to track the target.

From the input information, estimates or predictions of target position are generated at predetermined rates. The target position estimation signals are calculated from the last estimated position, target velocity and target acceleration estimation signals, and are utilized to point the antenna at the moving target and to make adjustments in the flight path of the missile. An optimal estimating system that is well suited for program implementation in a high-speed digital computer is the estimator known as a Kalman filter. The Kalman filter is well known in the literature and may be defined as an optimal recursive filter that is based on space and time domain formulations.

Typically, a Kalman filter or estimator processes the measured information concerning moving targets such as range, radial velocity, elevation and azimuth to develop signals that represent estimates of target relative position, target relative velocity and target acceleration. An additional set of parameters is developed representing the uncertainty in the estimation of target position and its time derivatives. The elements of this set of parameters are called the error covariances of the estimation model. A second set of error covariances represents the mean squared error in measurement of range, radial velocity, azimuth and elevation.

Any difference between a predicted value of an estimated quantity and its measured value is commonly called a residual. This residual is composed of errors in estimation and errors in measurement. Clearly, not all of an observed residual should be used to correct errors in estimation since the residual itself contains measurement errors. A Kalman gain factor is formulated which seeks to take that fraction of a residual which is due to estimation error alone. This fraction of the residual is then used to revise the estimation model after each observation or measurement. The revised estimates are then used to predict the results of the next measurement, and the process is repeated.

The measured quantities as well as the quantities for predicting the position of the target must be referenced to a coordinate system. Typically, a Cartesian coordinate system in the inertial reference is employed for simplicity reasons. A line-of-sight (LOS) or antenna coordinate system which extends along three axes, or alternatively, an aircraft or missile coordinate system may be used, with the longitudinal axis of the aircraft or missile being the basis for a three-axis system. In addition, an onboard inertial reference unit (IRU) supplies information as to the missile state and position in the inertial frame.

The signals described above, as well as tracking error signals of the antenna, are input to and operated upon by the onboard executive computer to calculate the various output signals for positioning the antenna to maintain its track on a target and to control the missile itself. These signals are employed to formulate a liner dynamic model to provide predictions of target position, velocity and acceleration. Measured quantities, such as range, range rate, elevation and azimuth angles and interdependent when calculating target position, velocity and acceleration. For n interdependent parameters there would be $n \times n$ sets of calculations involved in the direct generation of the Kalman gain factors. For the three spatial components (the LOS axes mentioned above) of target position, velocity and acceleration, $n=9$ in a stable, for example, geographic, coordinate system.

In a LOS coordinate system, the measured quantities of range, range rate, azimuth and elevation angles are independent of each other. When using a LOS coordinate system, the Kalman gain computations are greatly simplified and the number of computations are substantially reduced. However, the orientation of the LOS system moves with time as the antenna-carrying aircraft or missile moves in three-dimensional space. In conventional systems, formulated wholly within the LOS coordinate system, this change in the LOS orientation customarily employs rate gyros to measure the reorientation and results in a non-linear system model to predict the target's position, velocity and acceleration. Nonlinear system models require more complex computations involving complicated weighting factors to make these predictions.

It should be noted that the above discussion assumes that measured range information is available as an input to the Kalman filter. When range or range rate information is not available, the problems associated with controlling the missile flight toward intercept of the target are significantly increased. In a jamming environment accurate measures of target range and range rate information are effectively denied.

For target state estimation in a jamming environment, only the passive LOS data from sensors onboard the missile are generally available for midcourse guidance.

A straightforward triangulation method that makes use of target LOS from both the missile and the mother ship, as well as the IRU supplied missile position relative to the launching platform, can be used to estimate the target location. This deterministic scheme relies exclusively on the latest fix, or position constraints, which tend to forfeit all information extrapolated from previous data and kinematic history. This can cause the system to be vulnerable to occasional large errors in the low resolution angular data or data dropouts from uplink.

Another possible approach is to use a weighted least squares filter for target ranging with some simple target modeling assumed over a finite filter memory length. Major drawbacks here are the inflexibility due to the batch-processing nature of the filter and the insufficiency in modeling the missile IRU error contribution.

A recursive, Kalman-type, digital, optimal filtering technique for a complete model of the target, missile and measurements offers considerable improvement in accuracy and ease of implementation over the weighted least squares filtering method. However, the optimal Kalman filtering approach to the problem involves not only the modeling of the target state, but also the missile state, IRU errors, measurement biases, and other systematic errors. This requires an eighteenth order filter and imposes an unacceptable computer burden on the available on-line estimation scheme. A module decoupling that estimates only the target acceleration, velocity and position in the downrange, off-range and altitude components, will reduce the filter to the order of nine. Each filter iteration would take about 24 ms to process the first set of sensor input data following the extrapolation, and processing each additional set of input data from other sensors adds about 3 ms. Including models for the two IRU misalignment angle errors increases these estimates to 43 and 4 ms, respectively. Thus, implementing the three-dimensional estimator with IRU correction is marginal with present computer speed and system frame of about 100 ms.

In addition to the actual implementation limitation problem, the higher order filter imposes more severe requirements on component tolerances such as unmodeled IRU error than a lower order scheme. If the component tolerance can be met, the higher order scheme should render more accurate estimates, but as the uncertainty increases, the performance will degrade much faster than for the lower order state-reduction system.

Finally, in a multi-mode passive ranging guidance system where target data is being directly received by missile onboard sensors and indirectly from the mother ship uplinks, IRU errors result in missile platform tilt and alignment errors in the missile-to-target LOS that must be corrected in order to obtain accurate LOS angle estimates.

SUMMARY OF THE INVENTION

In order to solve some of the problems mentioned above concomitant with passive ranging, where range measurement information is not available, it is possible to decouple the three-dimensional, nine-state filter into two coupled single-plane filters, each one having an unspecified filter parameter. This type of state reduction technique is based on insight of the sub-optimal filtering scheme. The unspecified filter parameters provide crosstalk between the horizontal and vertical filters and also serve as discrepancy parameters to help identify the discrepancy in the range estimates from each. For explanation of minimum sensitivity design principle and sub-optimal filtering, see Gelb, "Applied Optimal Estimation", pages 227–260 (1974).

Without proper trajectory shaping for the fixed altitude cruise mode, the elevation LOS rate is too small to help reduce the range estimation error. Stated another way, this poor geometry will incur very slow rotational rate for the estimation error ellipsoid needed to lower the range variance based on self-triangulation with the past data on the missile's own trajectory. To improve the triangulation geometry, it has been determined that the intercept missile should fly a parabolic offrange trajectory. To fully exploit this geometry enhancement, a system has been devised that employs a seven-state filter for the horizontal plane that can accommodate the azimuthal LOS angle combined with the time histories of the data that reflects the good off-range geometry. Additionally, a smaller four-state filter is employed for the vertical plane which does not directly estimate the downrange component, except through a cross coupling parameter from the larger filter. This choice of the two coupled single-plane filters with the larger state vector in the horizontal plane also provides advantages as a data mixer for incorporating data from third party aircraft based on horizontal scanning from that aircraft.

In that system, a recursive, digital filter is embedded in the executive computer in the central control system of the missile. The multi-mode HOJ/ARH (Home-On-Jammer/Anti-Radiation Homing) system includes passive sensor subsystems at B, F, G, I, J and K-bands.

The system employing two coupled single-plane filters in MMG where measured range information is denied substantially reduces onboard computational burden for on-line state estimation and parameter identification, and at the same time provides sufficient accuracy for midcourse control of the intercept missile. Even without range information, this system provides information from which the estimated time-to-go can be calculated, provides reconstructed missile-to-target line-of-sight and provides estimates of range and range rate. This information will assist on-line decision making processes concerning missile turndown and active/IR enable for terminal handover. This system is especially adapted for use in jamming environments where range and range rate information are not available.

One of the objects of this invention is to identify IRU errors and construct correction terms to recover the missile true position in order to obtain smoothed LOS angle estimates.

Discrepancy parameters are employed to indicate the mismatch between ship inertial and missile IRU coordinate frames when both the missile onboard and the ship uplinked passive data are processed simultaneously. These parameters are used to identify the IRU errors and construct correction factors which, in turn, can be utilized to reduce the discrepancies due to the missile/-ship coordinate frame mismatch. In this way, the IRU errors are corrected for.

Once the missile state is properly updated, the IRU data can be coupled with the onboard target state estimator outputs to reconstruct the smoothed LOS angles.

BRIEF DESCRIPTION OF THE DRAWING

This invention will be more clearly understood from the following detailed description when read in conjunction with the accompanying drawing in which.

DESCRIPTION OF THE PREFERRED EMBODIMENT

At the outset, several definitions will be useful.

The underlying principle of multi-mode guidance (MMG) policy is to develop compatible mode weighting/selecting and data mixing computational algorithms which will enable updating by full or partial fixes from an arbitrary array of onboard sensors and telemetry channels at any data rate, accuracy and sensitivity. From launch to intercept the system should process the continuous velocity increment and attitude information from the inertial reference unit (IRU), together with uplink data from the mother ship or launching platform for missile and target position fixes. The system should also be able to handle similar telemetry data from nearby aircraft or downlink satellite/global positioning system (GPS) data.

The conventional guidance filtering design requires different filters for different sensing modes, with numerous time-varying parameters to match the response functions with the input data. From multi-mode considerations this may involve some redundancy in design, degradation in performance temporarily after mode switching, maneuvers or other transients, and rigidity with specific sensor operating modes and data rates. It may also fail to recognize the proper sensing mode after intermittent blackout or loss of lock-on when data rates vary widely.

It is a purpose of this invention to provide advanced MMG filtering designed to a high degree of system integration, and to provide multiple outputs from multiple inputs with complete multi-mode flexibility.

This invention is adapted to provide missile guidance with a passive ranging scheme. Where range information is denied by jammers, passive RF receivers to detect the jamming emissions are employed to home on the jammers (HOJ).

As employed in this invention, the target state estimator uses LOS data and, by recursive estimation, obtains target position, velocity and acceleration information. In addition, this system identifies IRU errors and provides correction terms to enhance smoothed LOS angle estimates.

Figure 1:
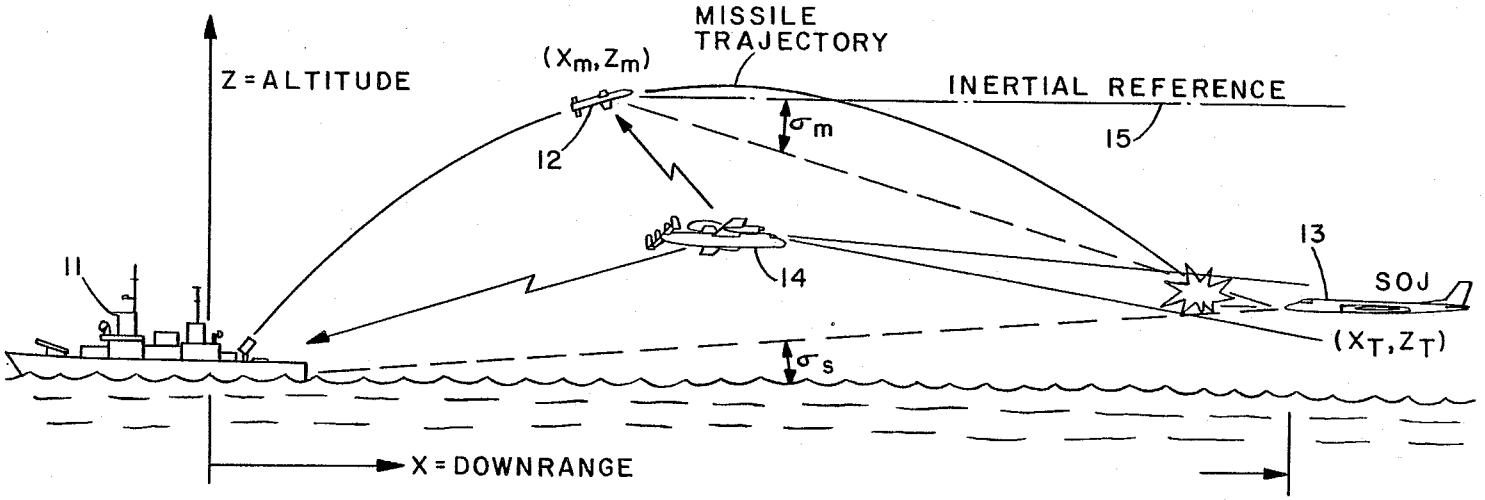
FIG. 1 schematically shows a basic triangulation scheme in the vertical plane.

With reference now to the drawings, and more particularly to FIG. 1, a basic triangulation scheme together with a third party aircraft is shown in schematic form. The mother ship 11 from which the missile 12 was launched has a line-of-sight (LOS) angle $\sigma_s$ to target 13. The target may well be a standoff jammer (SOJ) which denies the ship, third party aircraft 14, and missile 12 a direct measure of range or range rate. Note that the missile is on a parabolic off-range trajectory which improves the triangulation geometry which is important in view of the relative small missile to target LOS angle $\sigma_m$. It can be seen from FIG. 1 that a significant change in range of target 13 will likely result in an insigificant change in LOS angles from ship and missile. The downrange distances from the ship for the missile and the target are designated by $X_m$ and $X_T$ respectively, and their respective altitudes are designated $Z_m$ and $Z_T$. A horizontal inertial reference line 15 from the missile provides the reference for the LOS angle from the missile to the target. Information from sensors onboard aircraft 14 may be sent to ship 11 before being processed and transmitted to missile 12 or it may be transmitted directly to the missile for processing in the onboard computer.

As implemented, this system can function as necessary for midcourse guidance with onboard sensors and information only, by means of self-triangulation. It can also integrate data uplinked from the mother ship, GPS downlink or with bearing data from third part aircraft.

Figure 2:
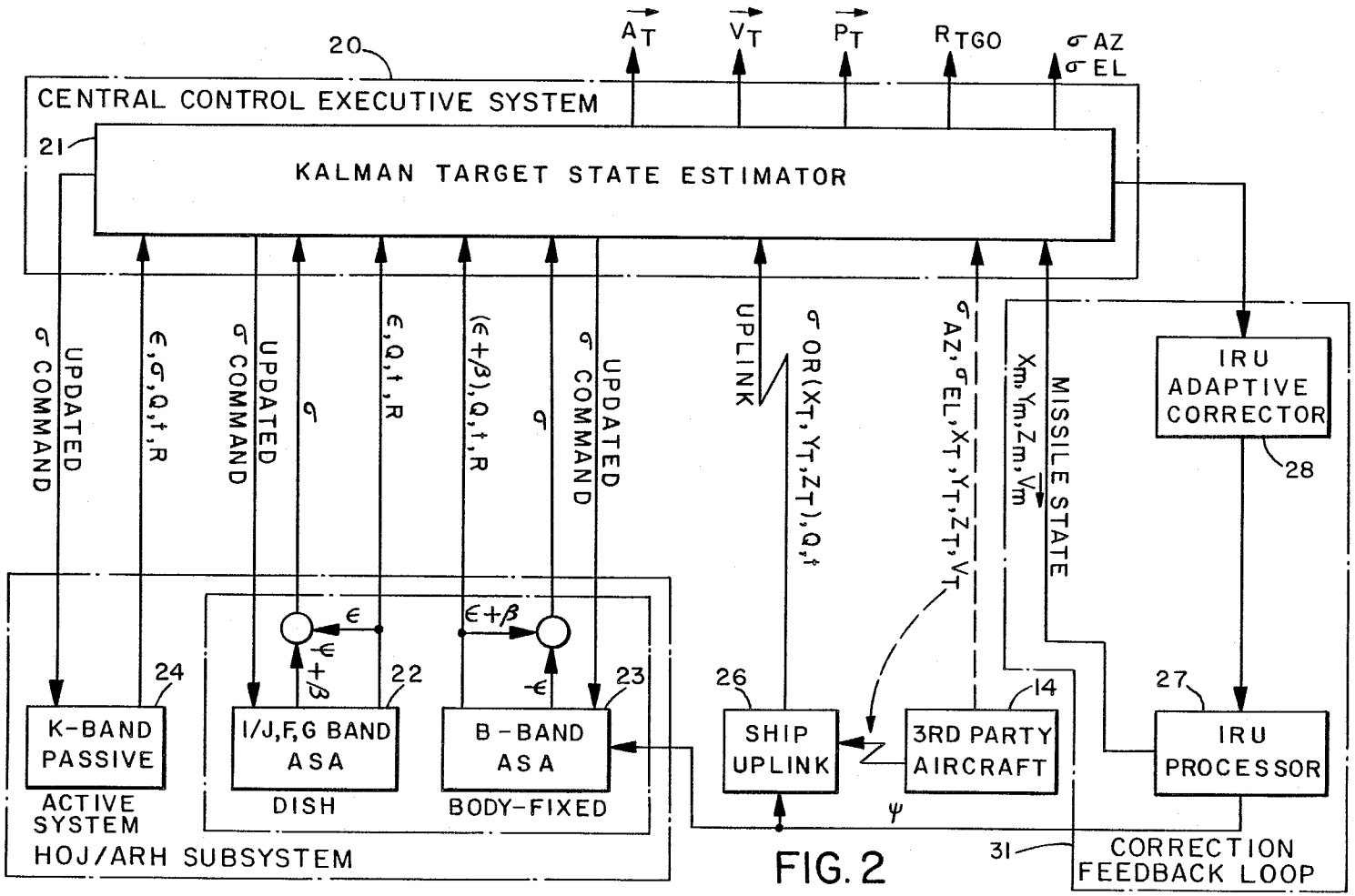
FIG. 2 is a block diagram of the functional system for the target state estimator of this invention.

The overall system function diagram for the target state estimator of this invention is shown in FIG. 2. This is a recursive, digital filter embedded in the executive computer in the central control system 20 of the missile. Passive sensors for various radiation bands are shown providing input to the Kalman estimator 21. The I/J, F and G band antenna system 22 on the gimballed seeker dish measures tracking error ($\epsilon$) between the target LOS and the seeker center line which is positioned by the executive computer system and updated occasionally based on the reconstructed LOS angle $\sigma$. The actual look angle $\beta$ measured by the gimballed pickoff is then added to the airframe angle $\psi$, measured by the IRU to provide the rate gyro platform angle $\theta$ which is then added to $\epsilon$ to yield the measured LOS angle $\hat{\sigma}$, thus $$\sigma=\epsilon+\theta, \text{ and} \tag{1}$$

$$\theta=\psi+\beta. \tag{2}$$

This raw data is required for passive ranging in the position mode.

As for the body-fixed B-band antenna system 23, it actually measures $\epsilon+\beta$ which can then be coupled with the airframe angle $\psi$ to give the LOS angle $\sigma$. It is also desired to accumulate the $\epsilon+\beta$ history to detect the measurement noise variance.

Antenna systems 22 and 23 include processors referred to as Angular Statistics Accumulator (ASA) to separate target returns from each other. When received signals entering the ASA reach a peak the existence and angular position of a target is established. The ASA is included as part of the system for completeness of description, but it forms no part of the invention and need not be detailed here.

The K-band antenna 24 in the active subsystem can also be used as a passive ARH sensor and it is used in that manner in this system. This antenna will procure the data in a manner similar to that of the I/J plate sensor.

Each sensor has a measurement noise variance which is a prerequisite for the Kalman-type measurement updating scheme to yield optimum, self-adaptive weighing of each data. The actual target estimator output, such as the target acceleration $\vec{A}_T$, velocity $\vec{V}_T$, position $\vec{P}_T=(\hat{X}_T,\hat{Y}_T,\hat{Z}_T)$, the range-to-go ($R_{TGO}$) and the reconstructed LOS angle $\sigma$ for both azimuth ($\sigma_{AZ}$) and elevation ($\sigma_{EL}$) angles, are rather insensitive to the $\epsilon$-variance. Thus a quick-look type detector is normally sufficient.

Block 14 in FIG. 1 represents the third party aircraft which provides passive bearing angles $Y_T$, or active positioning data ($X_T,Y_T,Z_T$) in the non-jamming situation, which are preferably linked to the missile 12 by way of ship uplink 26. This preference is a result of the fact that the target estimator adopts the ship as the origin of the inertial Cartesian coordinate frame used to determine target position. With the ship tracking aircraft 14, it is only a relatively simple coordinate translation matter to combine the aircraft datta with the ship data. In addition to the ship's active positioning data in the non-jamming case, the ship can also render azimuthal and elevation LOS angles in the passive jamming mode for targets above the horizon.

It should be noted that each output from antenna systems 22, 23, 24 and ship unlink 26 as input to the onboard executive computer includes a time tag t. Each subsystem sends data at its own rate and it is a function of the Kalman target state estimator to adjust for time variations in data rates. The microprocessors associated with the sensors send to the executive computer not only azimuth and elevation angle, but variance and quality factors (noise) as well. Target position estimates are made by the executive computer based on the model information and the unprocessed inputs from the microprocessors. In addition, control update signals are fed back to the sensors based on processed data and the predictions generated.

Missile IRU processor 27 also supplies missile state information ($X_m,Y_m,Z_m,\vec{V}_m$) with respect to the ship origin to the executive computer for calculating the predicted LOS angular measurement nominals and partials. This missile state information is corrected by means of correction feedback loop 31 to provide updated, correct missile data.

Implementation of this guidance scheme is accomplished by means of a recursive Kalman filter with the target model programmed into the onboard computer. The estimator constantly updates with new LOS data from the last prior step to refine the prediction. However, the estimator is also cumulative, taking all past data into consideration with the oldest having the least weight in the calculations.

The present invention is applicable to any type of guidance system having IRU input data as to missile state, not just the two coupled single-plane filter system mentioned above. However, it will be convenient to discuss this invention, at least in part, with respect to that system where the kinematic modeling of the target state estimator involves a seven-state horizontal and a four-state vertical filter that are crosstalked through discrepancy parameters.

To reiterate, the Kalman filter has two important functions or parts, kinematic modeling and measurement updating. The following section is primarily concerned with the modeling function.

Kinematic Modeling

The seven-state vector in the horizontal plane is defined as follows:

$$\vec{X}_H=(A_X,A_Y,V_X,V_Y,X_T,Y_T,\Delta X_H), \tag{3}$$

where $A_X$ is the downrange target acceleration component,
$A_Y$ is the off-range target acceleration component,
$V_X$ is the target velocity downrange component,
$V_Y$ is the target off-range velocity component,
$X_T$ is the target downrange position component,
$Y_T$ is the target off-range position component, and
$\Delta X_H$ is a correlation or discrepancy parameter.

The four-state vector in the vertical plane is defined as $$\vec{X}_V=(A_Z,V_Z,Z_T,\Delta X_V), \tag{4}$$

where $A_Z$ is the target acceleration component in the vertical direction,
$V_Z$ is the target velocity component in the vertical direction,
$Z_T$ is the target altitude component, and
$\Delta X_V$ is the discrepancy parameter for the target range estimate.

Both $\Delta X_H$ and $\Delta X_V$ are used to provide crosstalk between the two single-plane filters.

The state dynamics in continuous form are given by linear matrix equations $$\dot{\vec{X}}_H=\vec{F}_H\cdot\vec{X}_H+\vec{\omega}_H, \tag{5}$$

$$\dot{\vec{X}}_V=\vec{F}_V\cdot\vec{X}_V+\vec{\omega}_V. \tag{6}$$

It is not necessary to set out the matrices for $\vec{F}_H$ and $\vec{F}_V$ and for the plante noise vectors $\vec{\omega}_H$ and $\omega_V$. However, in the matrices, a band-limited target acceleration model with bandwidth $1/\tau_X$ for the downrange component, etc., has been assumed. Low pass filters with time constants $\tau_H$ and $\tau_V$ which describe the first order Markov process of these correlated discrepancy parameters are employed. Associated white noise disturbance processes, $\omega_{AX}$, etc., account for the unmodeled errors in target acceleration and correlation parameters. Time constants $\tau_X$, $\tau_Y$ and $\tau_Z$ are chosen to be 20 seconds to model circling or porpoising jammer acceleration. For the discrepancy parameters, time constants $\tau_H$ and $\tau_V$ are chosen to be 400 seconds for the case of no IRU errors, but are adjusted inversely proportional to the gains in the adaptive IRU correction feedback loop. The IRU correction will be further described in detail in this specification.

The matrix Equations (5) and (6) can be easily integrated to give solution at time t in the form $$\vec{X}_H(t) = \Phi_H(T)\cdot\vec{X}_H(t_0) + \int_0^T \Phi_H(T-T')\vec{\omega}_H(T')dT', \tag{7}$$

$$X_V(t) = \Phi_V(T)\cdot X_V(t_0) + \int_0^T \Phi_V(T-T')\omega_V(t')dT'. \tag{8}$$

In the transition matrices $\phi_H(T)$ and $\phi_V(T)$ have $T=t-t_0$ as the transition time.

The filter covariance in the continuous form can be written down in the following equation, with the subscripts H and V being omitted for simplification.

$$P(t)\equiv E[\vec{X}(T)\vec{X}^T(T)]=\phi(T)\cdot P(t_0)\cdot\phi^T(T)+Q(t) \tag{9}$$

The plant noise covariance matrix is relatively complex and need not be set out here. Various plant noise RMS component values in the matrix are as follows:

$\sigma_{AX}$ is the initial RMS downrange component value of the target acceleration plant noise, $\sigma_{AY}$ is the initial RMS off-range value of the target acceleration plant noise, $\sigma_{AZ}$ is the initial RMS vertical component value of the the target acceleration plant noise, $\sigma_{\Delta H}$ is the RMS value for the horizontal plane discrepancy parameter plant noise, and $\sigma_{\Delta V}$ is the RMS value for the vertical plane discrepancy parameter plant noise.

As a specific example, the target acceleration plant noise values are chosen to be 0.0667 g to produce realistic target state standard deviations after 300 seconds of flight. The discrepancy parameter plant noise values are chosen to be 3 kft to reflect the IRU degradation. The cumulative IRU error contribution to miss distance must be accounted for, the amount depending on the relevant conditions, including length of flight. Thus the filter is initialized for the expected flight conditions. The various plant noise component functions are given by $$Q_{AA}(\tau) = \frac{1}{2}(1 - e^{-2T/\tau}), \tag{10}$$

$$Q_{AV}(\tau) = \frac{\tau}{2}(1 - e^{-T/\tau})^2,$$

$$Q_{VV}(\tau) = T^2\left(\frac{T}{\tau} - \frac{3}{2} + 2e^{-T/\tau} - \frac{1}{2}e^{-2T/\tau}\right),$$

$$Q_{AP}(\tau) = \frac{\tau^2}{2}\left(1 - \frac{2T}{\tau}e^{-T/\tau} - e^{-2T/\tau}\right),$$

$$Q_{VP}(\tau) = \frac{\tau^3}{2}\left(\frac{T}{\tau} - 1 + e^{-T/\tau}\right)^2, \text{ and}$$

$$Q_{PP}(\tau) = \tau^4\left[\frac{T}{\tau} - \left(\frac{T}{\tau}\right)^2 + \frac{1}{3}\left(\frac{T}{\tau}\right)^3 + \frac{1}{2}\left(1 - e^{\frac{-2T}{\tau}}\right) - 2\frac{T}{\tau}e^{-T/\tau}\right].$$

It should be noted that the above continuous solutions only depend on the time interval T due to the time invariance of the system Equations (5) through (8).

For a sampling period such as 1 second or less and with $\tau_A$'s chosen to be 20 seconds to model the target acceleration, the above exponential terms can be expanded and all the higher than linear order terms dropped in $(T/\tau)$ except for the diagonal elements. Within this linear, discrete approximation the transition matrices $\phi_{H,i+1}$ and $\phi_{V,i+1}$ the discrete state at $t_i$ to $t_{i+1}$ can, with sampling period $T=t_{i+1}-t_i$, be written.

The plant noise covariance matrices can also be similarly linearized. The $Q_{AA}$ term remains intact while $$Q_{AV}(\tau) \simeq \frac{T}{2}\left(\frac{T}{\tau}\right). \tag{11}$$

-continued $$Q_{VV}(\tau) \simeq \frac{T^2}{3}\left(\frac{T}{\tau}\right),$$

$$Q_{AP}(\tau) \simeq \frac{T^2}{6}\left(\frac{T}{\tau}\right),$$

$$Q_{VP}(\tau) \simeq \frac{T^3}{8}\left(\frac{T}{\tau}\right), \text{ and}$$

$$Q_{PP}(\tau) \simeq \frac{T^4}{20}\left(\frac{T}{\tau}\right).$$

The usual approximation, by dropping all the terms in Equation (11) above as compared to $Q_{AA}$ term, is valid to the first order only if the sampling time T is much less than one second. For the ship's third party aircraft active positioning data, the sampling period can be as large as 10 seconds. The linear discrete approximation would be expected to involve large truncation errors. For approximately constant sampling period T' given by $$T' = T + \Delta T,\ \Delta T << T, \tag{12}$$

with T being chosen to be the average constant filter time interval, the exponential term can be approximated by $$e^{-T'/\tau} \simeq e^{-T/\tau}\left(1 - \frac{\Delta T}{\tau}\right). \tag{13}$$

Thus it is only necessary to calculate the exponential $e^{-T/\tau}$ for various time constants once during the initialization stage and then adjust for the slightly varying sampling interval.

In this study the continuous form of the transition matrices and plant noise covariance matrices were used to avoid any possible error due to truncation. A sensitivity study indicates very small compromise involved in using the linear, discrete approximations when the filter time is chosen to be one second.

As a further example, it is normally necessary to account for IRU corrupted information about the missile trajectory. The initial misalignment uncertainly, $A_0$, is the dominant IRU error. Other assumptions include values for gYro drift RMS error A and instrument dependent position drift ($\epsilon_X$, $\epsilon_Y$, $\epsilon_Z$) for each axis to model the accelerometer bias. Thus the measured values for the missile position component ($X_m$, $Y_m$, $Z_m$) are given by $$X'_m = X_m + \dot{\epsilon}_X t - A_{0Y}Y_m - A_{0Z}Z_m$$

$$Y'_m = Y_m + \dot{\epsilon}_Y t + A_{0Y}X_m, \text{ and}$$

$$Z'_m = Z_m + \dot{\epsilon}_Z t + A_{0Z}X_m. \tag{14}$$

In this set of equations the prime, viz $X'_m$ indicates IRU error corrupted data. A similar term $(A_0 + At)$ will also be incorporated into the modeled LOS measurement nominals to simulate the effect of IRU misalignment in gyro drift error in the data.

Measurement Equations

The ship 11 from which missile 12 was launched is assumed to acquire the jamming target LOS, as long as the target is above the horizon, to within a zero mean Gaussian white error at a predetermined data rate for both azimuth and elevation angles. The ship-to-target LOS angles are given by $$\sigma^{s}_{AZ} = \mathrm{Tan}^{-1}\left[\frac{\hat{Y}_T}{\hat{X}_T + \Delta\overline{X}_V}\right] \tag{15}$$

and $$\sigma^{s}_{EL} = \mathrm{Tan}^{-1}\left[\frac{\hat{Z}_T}{\overline{X}_T}\right] \tag{16}$$

where the bar over a component indicates the sample and hold crosstalk from the other plane filter. Thus, the vertical filter actually uses the previously estimated target downrange value $\overline{X}_T$ from the horizontal filter to estimate the target altitude $Z_T$ based on the elevation LOS angle. The target range estimate discrepancy parameter $\Delta\overline{X}_V$ is not estimated by the ship data and has non-vanishing value only when blended with the missile data.

This ship data is uplinked and processed onboard the missile, together with the third party aircraft data if available, and missile multiple sensor input into the target state estimator to generate smooth estimates of the target position and velocity components. However, until correction terms are added by the IRU correction feedback loop, IRU misalignment errors can severely degrade the passive ranging target state estimator performance.

The third party aircraft can also provide a good triangulation geometry with either active target positioning data or passive bearing angle information. When available, the IRU misalignment errors become less significant. The aircraft is assumed to be stationary with respect to the ship at a predetermined location. Denoting ($X_A$, $Y_A$, $Z_A$) as the aircraft position components, the aircraft bearing angle measurement LOS is given by $$\sigma^{A}_{AZ} = \mathrm{Tan}^{-1}\left[\frac{\hat{Y}_T - Y_A}{\hat{X}_T - X_A}\right] \tag{17}$$

at a predetermined data rate. The aircraft active track positioning data comes in at a much slower rate with predictable target downrange, off-range and altitude positioning errors in the non-jamming environment.

With respect to the multiple sensors onboard the missile, the LOS data from the passive mode are given in the form of $$\sigma^{m}_{AZ} = \mathrm{Tan}^{-1}\left[\frac{\hat{Y}_T - Y'_m}{\hat{X}_T - X'_m + \Delta\hat{X}_H + \overline{\Delta X}_V}\right] \tag{18}$$

and $$\sigma^{m}_{EL} = \mathrm{Tan}^{-1}\left[\frac{Z_T - Z'_m}{\overline{X'}_T - X'_m + \Delta X_V}\right] \tag{19}$$

where ($\hat{X}'_m$, $Y'_m$, $Z'_m$) are the IRU corrupted missile position components. The quantity $\overline{X}'_T$ is the sample and hold value of ($\hat{X}_T + \Delta\hat{X}_H + \overline{\Delta X_V}$) crosstalked into the vertical filter to control the two-plane discrepancy. The discrepancy parameter $\Delta X_V$ estimated in Equation (19) is then sampled and held to be fed into the horizontal filter before extrapolation to the next filter step. $\overline{X}'_T$ should replace $\overline{X}_T$ in Equation (16) whenever available.

The two discrepancy parameters ($\Delta X_H$, $\Delta X_V$) should identify the onset of any mismatch between the ship and missile frame due to IRU misalignment error. Small angle approximations for the above equations are usually valid for long range intercepts.

It is not necessary to state the equations for RF active and passive EO terminal homing system because the target state estimator of this invention is primarily designed to process all the available information up to terminal phase, that is, for midcourse guidance, in seeker head position mode. After terminal handover, a much lower order filter with optimal Kalman-type structure with empirical noise-adaptive feature can be designed to incorporate the active RF and EO data in seeker head rate mode, together with the possibility of uplinked range and target acceleration information.

Kalman Filter Equations

The estimation problem described by the linear state dynamics in Equations (5) and (6) is slightly complicated by the non-linear measurement Equations (15) through (19), which when the information produced by the ship, aircraft and onboard sensors is combined, result in $$\sigma_{AZ} = \mathrm{Tan}^{-1}\left[\frac{\hat{Y}_T - Y_m}{\hat{X}_T - X_m + \hat{\Delta}X_H + \overline{\Delta X}_V}\right] \tag{20}$$

and $$\sigma_{EL} = \mathrm{Tan}^{-1}\left[\frac{\hat{Z}_T - Z_m}{\overline{X}_T - X_m + \hat{\Delta}X_V +}\right]. \tag{21}$$

These equations can be written in the general discrete form, at $t = t_j$, as $$Y_j = h(X_i) + n_j \tag{22}$$

where $Y_j$ represents $\sigma_{AZ}$, $\sigma_{EL}$, h is the arc tangent functional form, $X_i$ are state elements, and $n_j$ is a representation of noise.

The estimated azimuthal LOS angle $\hat{\sigma}_{AZ}$ from the horizontal filter is shown in Equation (20) as combining the arc tangent function of the estimate of target off-range angle $\hat{Y}_T$ less the missile off-range angle $Y_m$, divided by the similar downrange residue factor together with the discrepancy parameter $\Delta X_H$ (the seventh element of the horizontal state vector) and the cross talk discrepancy parameter from the vertical state vector $\Delta\overline{X}_V$. Similarly, the elevation LOS angle estimate $\hat{\sigma}_{EL}$ includes cross talk from the horizontal filter $\overline{X}_T$ and the discrepancy parameter $\Delta X_V$ (the fourth element of the vertical state vector). This shows the value of the discrepancy parameters and the cross talk in updating target position estimates.

In Equation (22) above, the discrete measurement noise is assumed to be zero mean and Gaussian white with covariance R resulting in the following equations, $$E(n_i)=O, E(n_i n_j^T)=R_i\delta_{ij}, \tag{23}$$

and $$\delta_{ij} = \begin{matrix} 1 \text{ for } i = j \\ 0 \text{ for } i \neq j \end{matrix} \tag{24}$$

To sequentially process the measurement data, it is first necessary to initialize the filter with the a priori mean and covariance of the estimated states, denoted by $\hat{X}_0$ and $P_0$, respectively. It is then possible to make use of the discrete dynamics of the transition matrices $\phi_{H,i+1'}$ and $\phi_{H,i+1'}$ to provide the prediction of the state estimates to the next measurement updating time, that is, $$\hat{X}_{\overline{H,i}}=\phi_{H,i}\hat{X}_{H,i-1}, \tag{25}$$

$$\hat{X}_{\overline{V,i}}=\phi_{V,i}\hat{X}_{V,i-1}, i=1, 2, \ldots \tag{26}$$

and, similarly for the filter covariance extrapolation as $$P_{\overline{H,i}}=\phi_{H,i}P_{h,i-1}\phi_{H,i}^T+Q_{H,i-1}, \tag{27}$$

$$P_{V,i}=\phi_{V,i}P_{V,i-1}\phi_{V,i}^T+Q_{V,i-1}, i=1, 2, \ldots \tag{28}$$

where $\hat{X}_i$ is the estimate of $X_i$ at the time $t_i$ based on the set of measurement $[y_0, y_1, y_2 \ldots y_{i-1}]$, $X_i$ is the estimate of $X_i$ at time $t_i$ based on the set $[y_0, y_1 \ldots y_{i-1}, y_i]$, $P_i$ is the filter covariance of $\hat{X}_{\bar{i}}$, $P_i$ is the filter covariance of $\hat{X}_i$, H is a subscript denoting the horizontal plane filter, and V denotes the vertical plane filter.

In prediction scheme Equation (25), $\hat{X}_{\overline{H,i}}$ is an extrapolation based on kinematic modeling, employing not only the discrete dynamics from the $\phi_{H,i+1'}$ transition matrix but the last estimate $\hat{X}_{H,i-1}$ based on the last measured data input. Equation (26) is of similar structure, applied to the vertical plane.

The Kalman gains are calculated recursively by $$K_{H,i}=\overline{P_{H,i}}H_{H,i}^T[H_{H,i}\overline{P_{H,i}}H_{H,i}^T+R_{H,i}+L_{H,i}]^{-1} \tag{29}$$

and $$K_{\overline{V,i}}=P_{V,i}H_{V,i}^T[H_{V,i}P_{\overline{V,i}}H_{V,i}^T+R_{V,i}+L_{V,i}]^{-1}, i=1, 2 \ldots \tag{30}$$

where H denotes the first order measurement partials $$H_i = \left(\frac{\partial h}{\partial X^T}\right)\Bigg|_{=\hat{X}_{\overline{H,i}}} \tag{31}$$

and L's are the non-linear corrections to be calculated later. The noise adaptive feature comes through the factor $[H_i \overline{P_i} H_i^T+R_i]$ which weights the measurement noise covariance $R_i$ against the measurement adjusted filter covariance matrix $P_{\bar{i}}$ which reflects the history of the kinematic modeling from the Equations (27) and (28).

The most recent data is then processed at $t_i$ to correct for the extrapolated state estimates $\hat{X}_{\bar{i}}$ through the optimal correction algorithm as $$\hat{X}_{H,i}=\hat{X}_{\overline{H,i}}+K_{H,i}[Y_{H,i}-h_H(\hat{X}_{\overline{H,i}})+\mu_{H,i}] \tag{32}$$

$$\hat{X}_{V,i}=\hat{X}_{\overline{V,i}}+K_{V,i}[Y_{V,i}-h_V(\hat{X}_{\overline{V,i}})+\mu_{V,i}], i=1, 2, \ldots \tag{33}$$

In Equations (32) and (33), the horizontal and vertical state estimates $\hat{X}_{H,i}$, $\hat{X}_{V,i}$ are recursively calculated from the most recent extrapolated estimate, e.g. $\hat{X}_{\overline{H,i}}$ from Equation (25), plus the Kalman gain factor correction term $K_{H,i}$ multiplied by the residue of the current measured LOS data $[Y_{H,i}$ less the arc tangent function of the most recent extrapolation $h(\hat{X}_{\overline{H,i}})]$ plus the nonlinear noise correction term $\mu_{H,i}$. The updated filter covariances are $$P_{H,i}=\overline{P_{H,i}}-K_{H,i}H_{H,i}P_{\overline{H,i}} \tag{34}$$

and $$P_{V,i}=P_{\overline{V,i}}-K_{V,i}H_{V,i}P_{\overline{V,i}}. \tag{35}$$

The above updated results are then substituted into Equations (27) and (28) for the next extrapolation to complete the cycle for the recursive, optimal estimation scheme.

Figure 3:
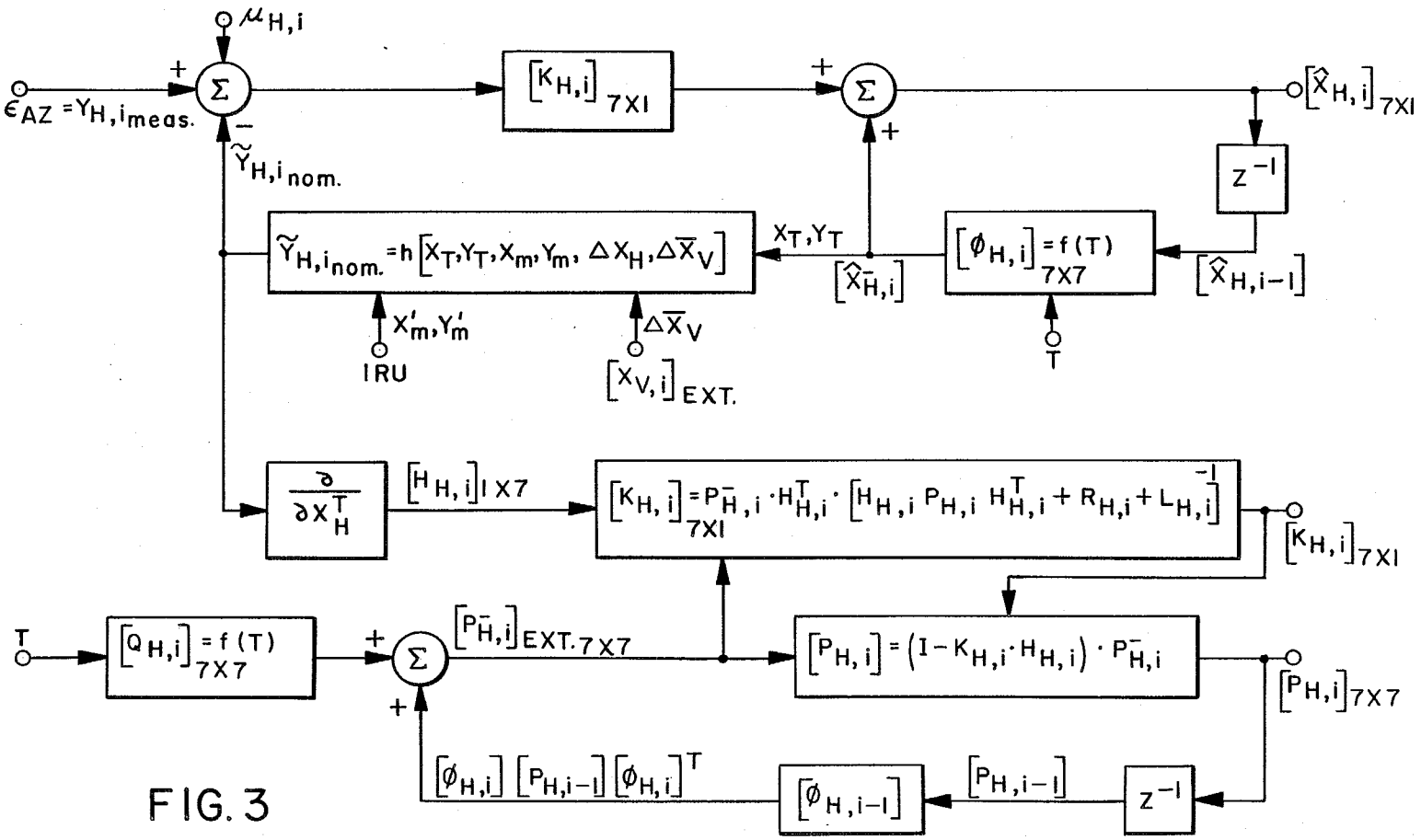
FIG. 3 is a functional block diagram of the horizontal filter of the invention.
Figure 4:
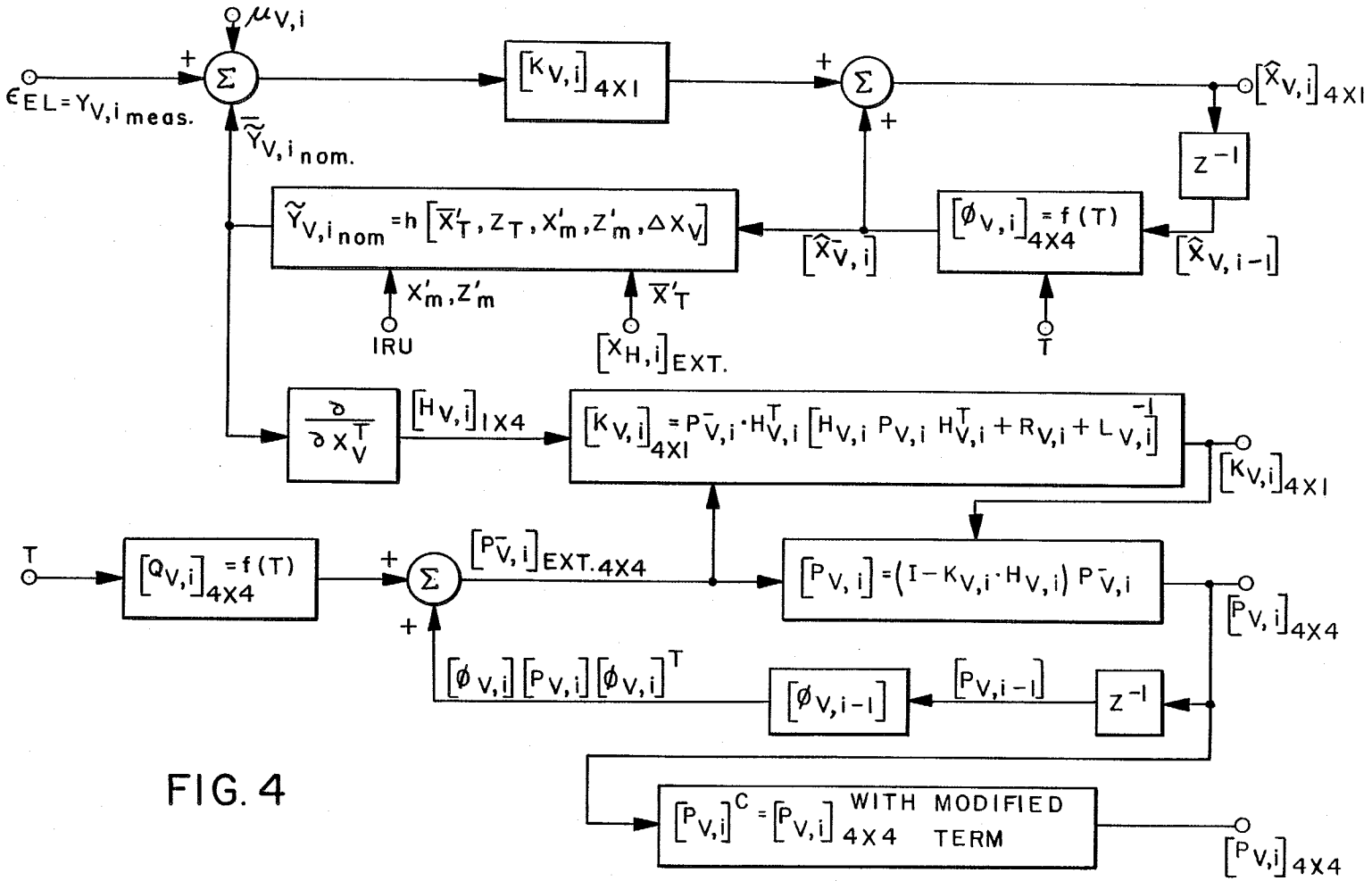
FIG. 4 is a functional block diagram of the vertical filter of the invention.

In the actual calculation, the azimuth LOS angle is processed using the horizontal larger filter first to estimate the range, range rate, etc. The estimated range and range rate information is used as an input to the vertical filter for processing the elevation LOS angular data, which occurs simultaneously with the azimuth data. A functional block diagram of the horizontal filter, showing the relationships of the foregoing horizontal filter equations, is shown in FIG. 3, while FIG. 4 shows the vertical filter in similar form. Note that a measurement input to each filter is seeker tracking error $\epsilon=Y_i$. Other external inputs include sampling period T, IRU measurements $X'_m$, $Y'_m$, $Z'_m$ and state estimates $X_{V,i}$, $X_{H,i}$ cross feedback into the other filters.

Figure 5:
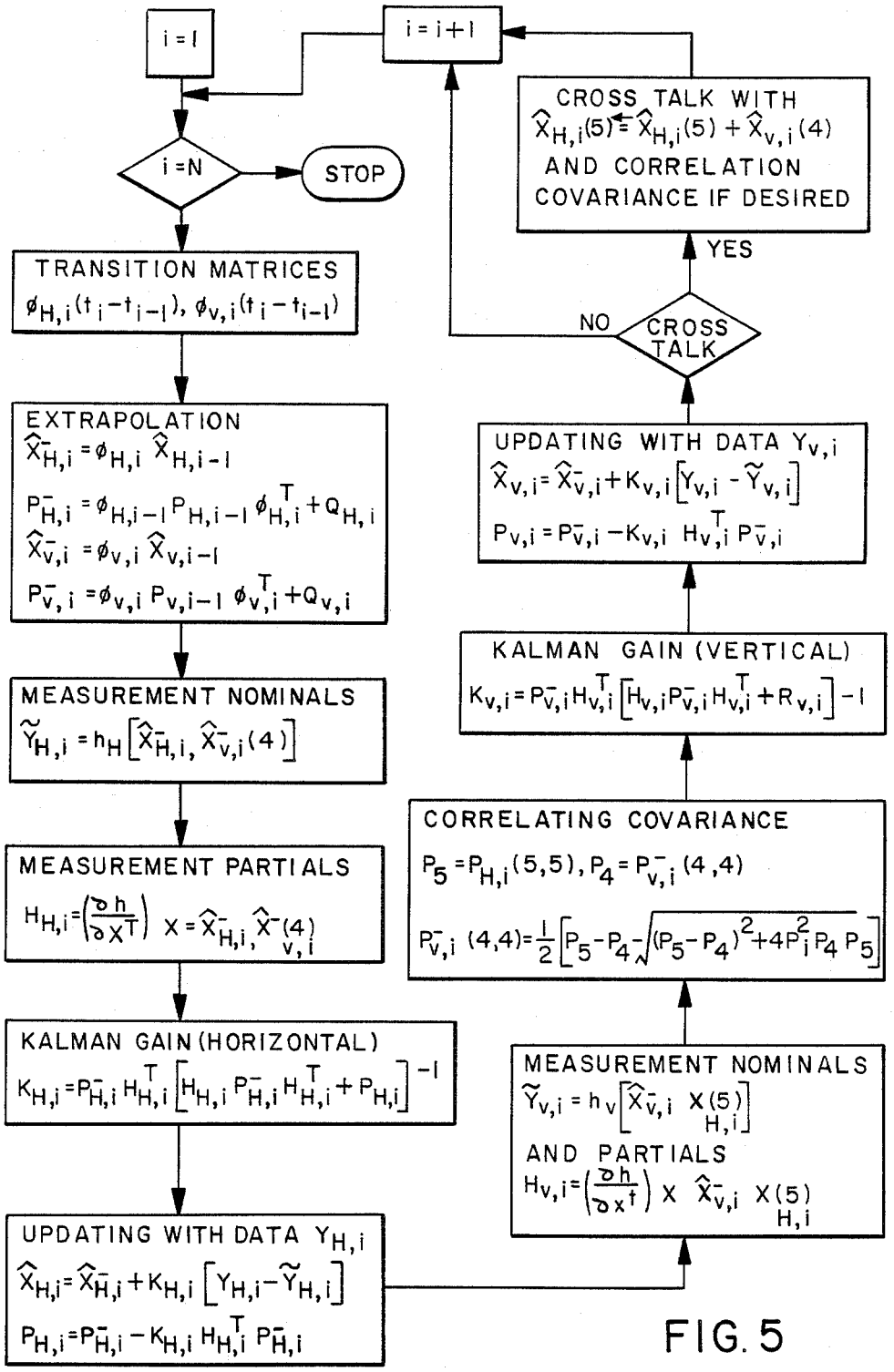
FIG. 5 is an estimator flow diagram showing the algorithm of the target estimation scheme of FIG. 2.

The algorithm of this target estimation scheme consists of the two coupled vertical and horizontal plane filters of FIGS. 3 and 4 represented in the flow diagram of FIG. 5. The i=1 block represents the first filter pass increment and the i=N block represents the last filter pass, where the estimating process stops. For simplicity reasons, the calculations involving the nonlinear correction terms are not shown.

A relatively simple mixing algorithm is introduced to correlate the variance $P_{H,i}^{(5,5)}$ for target position estimates and the extrapolted variance $P_{V,i}(4,4)$ for the discrepancy parameter $X_{V,i}$. The degree of correlation $\rho_i$ is tentatively chosen to be 0.5 and introduces adequate correlation between the two filters through the range crosstalk. Simulation results indicate that this choice introduces enough correlations to compensate for the state-reduction approximation.

One important detail omitted from FIG. 5 for the sake of clarity is the processing of multiple inputs. This is the unique characteristic of the MMG system that has multiple sensors onboard plus the offboard data through various communication channels. The standard approach in treating the measurement $Y_i$ as the vector consisting of m various data inputs at time $t_i$, does not exactly suit the purpose of this description. That would require enormous efforts for synchronizing the data from entirely different sources at widely variable data rates. It will thus involve m by m matrix inversion in Kalman gain calculations through Equations (29) and (30) and is also not flexible enough to allow data dropouts in the unpredictable electronic countermeasure environments. It is the goal of this invention to provide an optimal filter to the highest degree of system integration, and to provide multiple outputs continuously from multiple sensor inputs involving any data rates, including dropouts.

Since the measurement equations involve trigonometric functions for all LOS data, there is a nonlinear filtering problem. With kinematic target modeling described by linear dynamics, there is no need for the usual extended Kalman filtering technique designed to approximate the nonlinear dynamics problem. To correct the nonlinearity, a second order Gaussian filter is needed for the measurement processing portion of the filter. Such a filter for multiple measurements in vector form has been previously designed and is not the subject of this invention.

For the second-order Gaussian filter, the nonlinear bias corrections to the measurement nominals, these being the terms $\mu_{H,i}$ and $\mu_{V,i}$, has appeared in Equations (32) and (33), and can be written as $$\mu_{H,i} = \frac{1}{2} \sum_{j=1}^{N_H} \sum_{k=1}^{N_H} \frac{\partial^2 h}{\partial x_j \, \partial x_k} \bigg|_{X=\hat{X}_{\overline{H,i}}} P_{H,i}(j,k) \tag{36}$$

and $$\mu_{V,i} = \frac{1}{2} \sum_{j=1}^{N_V} \sum_{k=1}^{N_V} \frac{\partial^2 h}{\partial x_j \, \partial x_k} \bigg|_{X=X_{\overline{H},i}} P_{V,i}(j,k) \tag{37}$$

where $N_H$ denotes the order of the horizontal filter and equals seven, $N_V$ denotes the order of the vertical filter and equals four, $x_j$ is the $j^{th}$ element of the state vector, $x_k$ is the $k^{th}$ element of the state vector, and $P_{i(j,k)}$ is the $jxk^{th}$ element of the filter covariance $P_i$ at sampling time $t_i$.

The scalar h is a nonlinear function of the state vector and some crosstalk parameters from the vertical plane filter. The second-order derivatives are being evaluated at the current best estimates of the target state and some crosstalk parameters at filter time $t_i$. Thus, $\mu_i$ is a scalar, second-order bias compensation term at $t_i$.

Similarly, the nonlinear noise correction terms $L_{H,i}$ and $L_{V,i}$ to the Kalman gain calculations in Equations (29) and (30) through the scalar measurement noise variance $R_i$ can be expressed as $$L_{H,i} = \frac{1}{2} \sum_{i=1}^{N_H} \sum_{k=1}^{N_H} \sum_{l=1}^{N_H} \sum_{m=1}^{N_H} \left( \frac{\partial^2 h}{\partial x_j \partial x_k} \right) \bigg|_{X=\hat{X}_{\overline{H,i}}} \left( \frac{\partial^2 h}{\partial x_l \, \partial x_m} \right) \bigg|_{X=\hat{X}_{\overline{H,i}}} P_{H,i}(j,l) P_{H,i}(k,m) \tag{38}$$

and $$L_{V,i} = \frac{1}{2} \sum_{j=1}^{N_V} \sum_{k=1}^{N_V} \sum_{l=1}^{N_V} \sum_{m=1}^{N_V} \left( \frac{\partial^2 h}{\partial x_j \partial x_k} \right) \bigg|_{X=\hat{X}_{\overline{V,i}}} \left( \frac{\partial^2 h}{\partial x_l \, \partial x_m} \right) \bigg|_{X=\hat{X}_{\overline{V,i}}} P_{V,i}(j,l) P_{V,i}(k,m). \tag{39}$$

An adequate approximation to the above gain compensation terms can be given by $$L_{H,i} = 2\mu_{H,i}^2 \tag{40}$$

$$L_{V,i} = 2\mu_{V,i}^2 \tag{41}$$

The possible RF active tracking data in the clear mode may yield range and range rate information. Also, the ship and third party aircraft to target active positioning data in the non-jamming case can provide additional off-range and altitude information, which might be correlated through the pre-processors on board the ship and the third party aircraft. Those data only involve linear, trivial measurement equations. Thus, there will be no nonlinear correction terms so that $$L_i = \mu_i = 0. \tag{42}$$

The effect of the nonlinear correction terms on the target estimation are usually very small for long-range intercept trajectories due to the small LOS angle. The validity of the small angle approximation for the tangential relationship begins to fail near missile turndown and the nonlinear correction terms will become significant.

At the outset it was indicated that a nine-state optimal filter would be adequate to solve the midcourse guidance problem, but the computer would have to deal with a 9×9 matrix. For the size and speed of the available executive computer, this is not practical. This invention allows a large filter to be subdivided into two smaller ones with 6×6 and 3×3 matrices. The correlation factors lost by this sub-optimal state-reduction scheme are accounted for by adding a discrepancy parameter to each smaller filter, resulting in 7×7 amd 4×4 matrices. By effectively breaking down the larger filter and adding the discrepancy parameters and providing crosstalk as described, the results are actually improved over the larger filter in terms of accuracy and reduction in sensitivity, allowing greater tolerances in the filter components.

IRU Correction Loop

Figure 6:
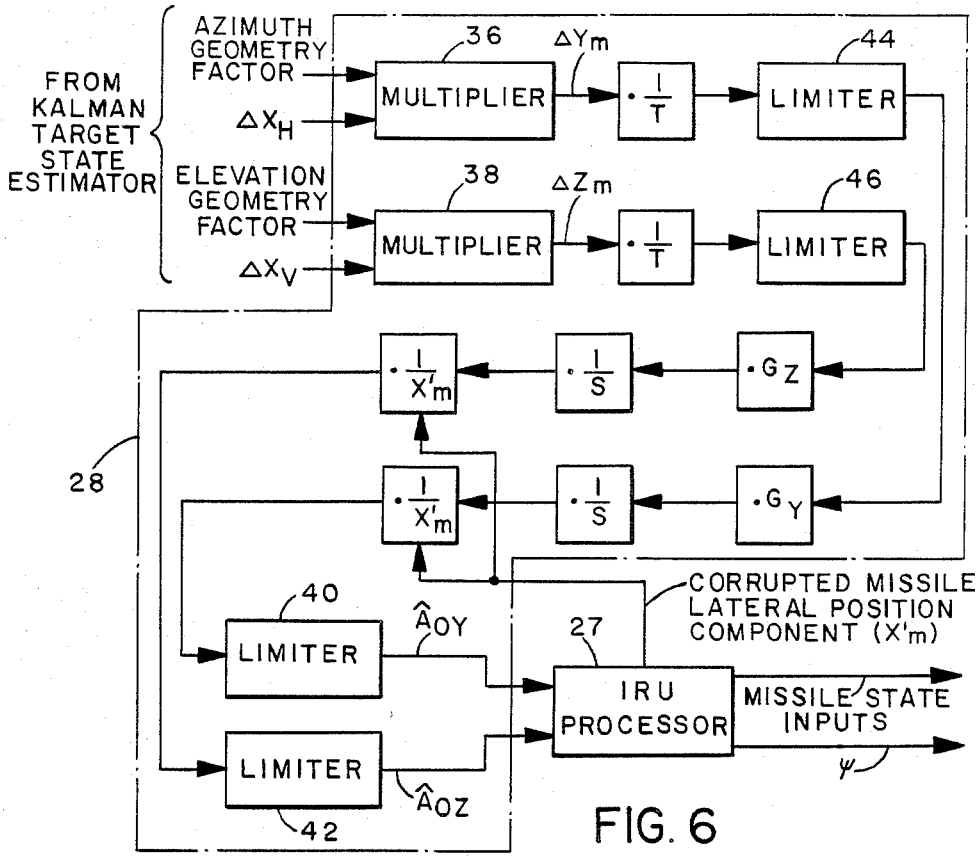
FIG. 6 is a functional block diagram of the IRU correction feedback loop of the invention.

With the foregoing as background description of a MMG system, showing the origins of the various parameters and equations, the IRU correction loop of the invention will now be discussed. A functional block diagram of an exemplary portion of the IRU correction loop is illustrated in FIG. 6.

As stated in the paragraph above which includes Equation (14), several factors are involved in the IRU misalignment to degrade the missile flight trajectory. The IRU corrupted information is dominated by the initial misalignment uncertainty. In order to employ the correction loop to best advantage, its effect is not employed until well into the missile flight, usually about half way to the target which typically is after an elapsed time of about 200 seconds. Of course, that time period depends on the total flight time, which varies.

Without correction, the IRU errors accumulate and become intolerable. In point of fact, the IRU misalignment error becomes the dominant contributor to the passive ranging estimation error.

Figure 9:
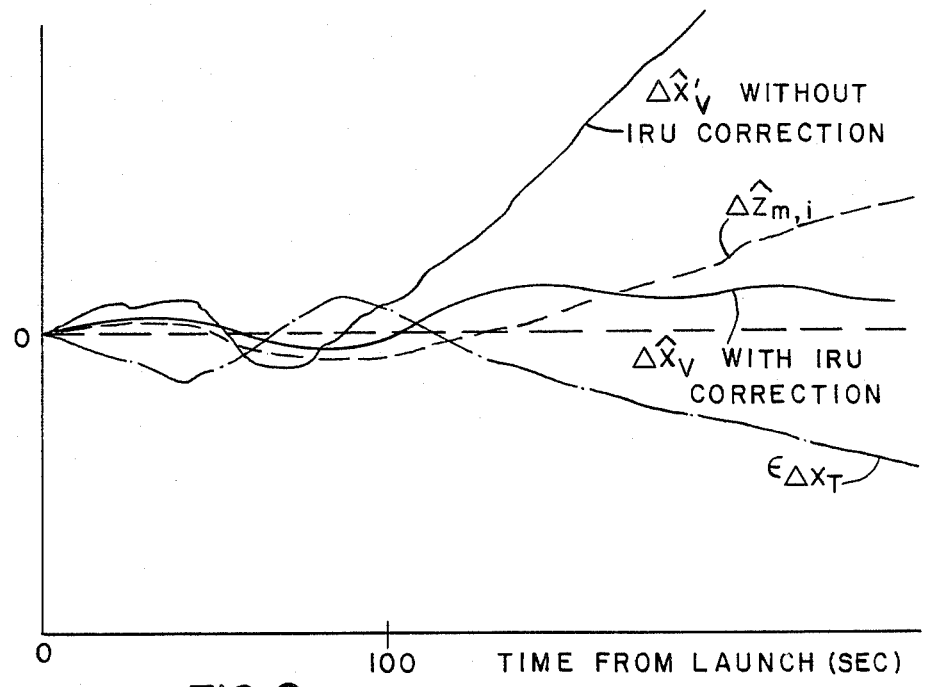
FIG. 9 is a generalized plot of a discrepancy parameter against time, with and without IRU correction.

Discrepancy parameters $\Delta X_H$ and $\Delta X_V$ have been defined above. It has been found that lateral errors in target estimation are small compared with vertical errors in a passive ranging system. This is because azimuthal data is much more accurate than elevation data. Thus discrepancy state parameter $\Delta X_H$ has a relatively small value with the IRU problem. However, the IRU error degrades the filter performance severely for the downrange estimates without third party aircraft azimuth data, but makes small difference for the Y/Z velocity component estimates. With the IRU error uncorrected, the target downrange estimation error never settles down while the discrepancy parameter $\Delta X_V$ increases monotonically and goes out of bound, as shown in FIG. 9. Observation shows remarkably different behavior in parameter $\Delta X_V$ for cases with and without IRU error, thereby demonstrating its utility to indicate the presence of an IRU problem. As will be shown below, this indicator can be used to identify and calibrate the IRU misalignment error and render a "smart" filter.

It is necessary to be cautious in interpreting increasing values of the discrepancy parameters as being caused by IRU errors. Firstly, the large uncertainty about target state at launch will cause big transients in the filter estimates, especially in the downrange component for passive ranging. These big transients in the $X_T$ estimation induce a large discrepancy parameter $\Delta\hat{X}_V$ which indicates mismatch errors between the vertical and horizontal triangulations that use the target downrange position as the common baseline. This kind of transient-induced discrepancy should not be confused with the IRU-induced results. Secondly, besides the initial IRU misalignment error $A_{oy}$ and $A_{oz}$, as defined in Equation (14), there are also gyro drift rate, accelerometer bias and other passive measurement biases and correlated errors. To differentiate and identify each contributor would require augmenting the state vector with at least four or five enforced parameters, leading to excessive computational burden. The best compromise is to blame everything on the IRU misalignment problem, which is, in general, the dominant degrading factor.

It is possible for the correction scheme of this invention to misinterpret the problem and cause over-correction. To prevent that it is necessary to introduce a limiter (44) on the update rates and IRU correction loop as shown in FIG. 6.

For purposes of completeness, the algebraic deviation of the IRU correction terms to account for the non-vanishing discrepancy parameters is set forth below. Equation (18) gives the azimuthal LOS angle for missile-to-target involving the discrepancy parameter $\Delta X_H$ in the denominator of the arctan function. Note that the azimuthal LOS angle from ship-to-target given by Equation (15) does not involve such a term. Therefore $\Delta X_H$ should characterize, among other things, the mismatch between missile and ship (reference) platforms.

A correction factor $\Delta Y_m$ will now be introduced as $$\Delta Y_m = Y'_m - Y_m = \Delta\hat{X}_H\left(\frac{\hat{Y}_T - Y'_m}{\hat{X}_T + \Delta\hat{X}_V - X'_m}\right). \tag{43}$$

This term is directly proportional to the estimated discrepancy parameter $\Delta X_H$, multiplied in multiplier 36 by the geometry factor, which is the approximate azimuthal LOS angle in the small angle approximation. If this correction term $\Delta Y_m$ is added to the numerator in Equation (18), the result is $$\sigma^m_{AZ} = \mathrm{Tan}^{-1}\left[\frac{\hat{Y}_T - Y'_m + \Delta Y_m}{\hat{X}_T + \Delta\hat{X}_V + \Delta\hat{X}_H - X'_m}\right] = \mathrm{Tan}^{-1}\left[\frac{\hat{Y}_T - Y'_m}{\hat{X}_T + \Delta\hat{X}_V - X'_m}\right] \tag{44}$$

In this way the measurement equation for $\sigma_{AZ}{}^m$ is cast in the same form as $\sigma_{AZ}{}^s$ in Equation (15), except for a shift in the origin of the coordinate frame. In other words, the correction term $\Delta Y_m$ thus introduced will reduce the discrepancy between the missile and ship coordinate frames.

In a similar manner, for the elevation LOS angular measurement equation the correction term in the altitude component is $$\Delta Z_m = \Delta\hat{X}_V\left(\frac{\hat{Z}_T - Z'_m}{\hat{X}_T - X'_m}\right) \tag{45}$$

which is proportional to the discrepancy parameter $\Delta X_V$ estimated in the small vertical filter multiplied in multiplier 38 by a geometry factor. The term $\hat{X}_T$ actually represents the value $(X_T+\Delta X_H+\Delta X_V)$ delayed and held from the last filter time. Incorporating this term into the numerator in the argument of the arctan function on the right side of Equation (19) we get $$\sigma^m_{EL} = \mathrm{Tan}^{-1}\left[\frac{\hat{Z}_T - Z'_m + \Delta Z_m}{\hat{X}_T + \Delta\hat{X}_V - X'_m}\right] = \mathrm{Tan}^{-1}\left[\frac{\hat{Z}_T - Z'_m}{\hat{X}_T - X'_m}\right] \tag{46}$$

which is cast in the same form as $\sigma_{EL}{}^s$ in Equation (16) except for a shift in origin.

The correction factors usually are much smaller than the discrepancy parameters due to the small angle geometry factor. From this the correction rates may be defined as $$DY_m \equiv \frac{\Delta Y_m}{T} \tag{47}$$

and $$DZ_m \equiv \frac{\Delta Z_m}{T}, \tag{48}$$

where T is the fixed filter time interval, chosen for study purposes here to be 120 ms. The correction rate is integrated to accumulate the effect of discrepancies along the past history, so the integrated correlation factors are $$\Delta\hat{Y}_{m,i} = \int_{t_c}^{t_i} DY_m \cdot G_Y \tag{49}$$

and $$\Delta\hat{Z}_{m,i} = \int_{t_c}^{t_i} DZ_m \cdot G_Z, \; i = 1,2, \ldots, \tag{50}$$

where $t_c$ is the time for beginning the IRU correction scheme, $t_i$ being the present filter time, and $G_Y$ and $G_Z$ being the corresponding feedback loop gains. Due to the induced discrepancy values from big transients during the first half of the flight, $t_c$ will typically be half of the total flight time and the IRU correction scheme will be used only for the second half of the flight. This approach is justified since IRU misalignment error will not be accumulated to the extent that it severely downgrades the filter performance during the first half of the flight.

The integrated correction factors $\Delta Y_m$ and $\Delta Z_m$ are then combined with the IRU corrupted missile lateral position components in Equation (14) to adjust the misalignment errors. The estimated misalignment angles $A_{oy}$ and $A_{oz}$ can also be used to compensate the IRU bias in the data collected.

As mentioned above, it is necessary, to put a ceiling on the correction rates and integrated results to prevent any unreasonably large overcorrection problem that may cause large overshoot in estimation errors. By way of example only, for the case of 0.36° RMS misalignment angles $A_{oy}$ and $A_{oz}$, a 0.4° limiter, limiters 40 and 42 can be used so that $$\left| \frac{\Delta\hat{Y}_{m,i}}{X'_m} \right| = \hat{A}_{oy} < 0.4° \times \frac{\pi}{180} \tag{51}$$

and $$\left| \frac{\Delta\hat{Z}_{m,i}}{X'_m} \right| = \hat{A}_{oz} < 0.4° \times \frac{\pi}{180} \tag{52}$$

It is also desirable to ensure that the correction rate is limited to reflect the true degradation due to the IRU problem. This is accomplished by using limiters 44 and 46 to respectively limit the values of $DY_m$ and $DZ_m$ prior to multiplying these values with the loop gains $G_y$ and $G_z$ before integrating the correlation factors. The value chosen is 3 $\sigma$(standard deviation) for $$|DY_m| < 3 \times 0.36 \times \frac{\pi}{180} \times V_c \simeq 100 \text{ ft/sec.} \tag{53}$$

and $$|DZ_m| < 3 \times 0.31 \times \frac{\pi}{180} \times V_c \simeq 100 \text{ ft/sec.} \tag{54}$$

The closing speed $V_c$ will be taken as about 5400 ft/sec for this example.

To illustrate the system, a target baseline model without third party aircraft will be used because it is more sensitive to the IRU problem. The first results presented will be for the case without any filter initialization errors, that is, perfect knowledge of the target is available. In this way the IRU problem alone can be concentrated on to demonstrate the correction scheme without worrying about the transient problem.

Figure 7:
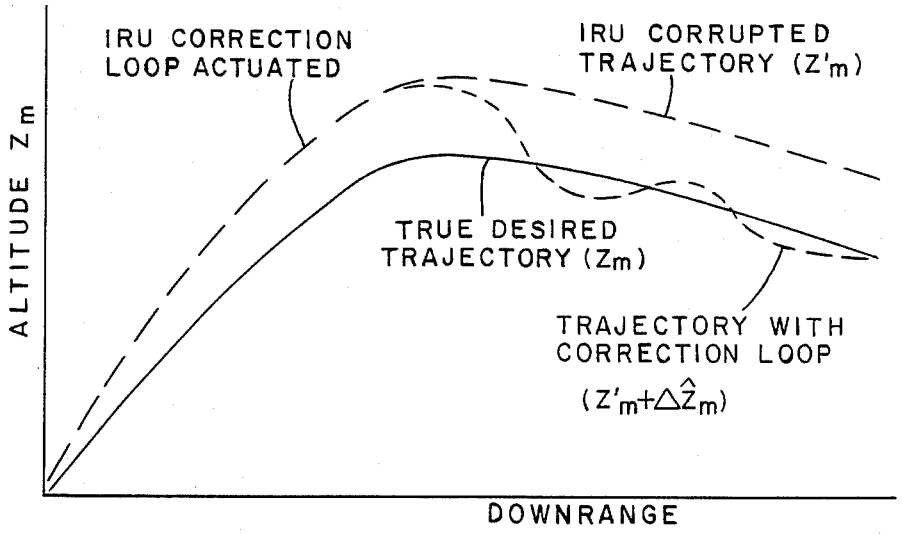
FIG. 7 is a generalized plot of missile altitude versus distance downrange, with and without IRU correction.

As shown in FIG. 7, the adaptive IRU correction loop is activated after the missile climbs to an altitude higher than the target altitude. For the missile altitude component, the correction loop works in the right direction to adjust $Z'_m$ with $\Delta\hat{Z}_m$ and brings the result very close to the true altitude $Z_m$.

Figure 8:
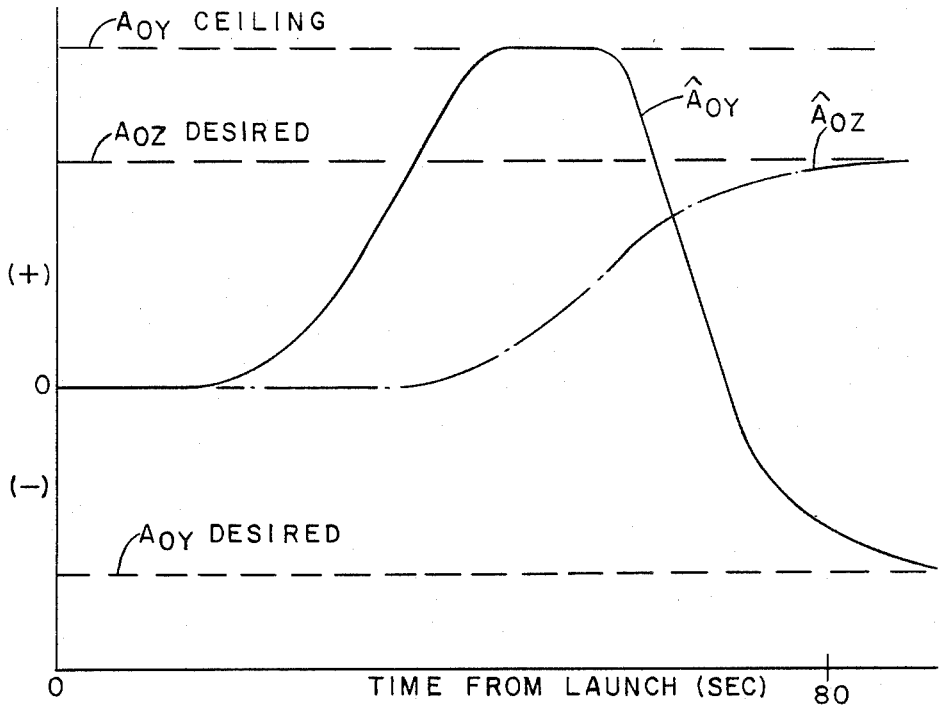
FIG. 8 is a generalized plot of initial misalignment angles against time after launch.

For the offrange component $A_{oy}$ it is chosen to be −0.36° to illustrate the case when the correction scheme works in the wrong direction and aggravates the IRU problem. In FIG. 8 the estimated misalignment angles $\hat{A}_{oy}$ and $\hat{A}_{oz}$ are shown. The adaptive correction loop of this invention realizes the mistake in $\hat{A}_{oy}$ and takes action to correct it. The correction rate can be speeded up by increasing the gain $G_y$ in Equation (49), which is chosen here to be unity. The estimated $\bar{A}_{oz}$ rises up rather slowly and reaches the limiter at around 80 sec, successfully correcting 90% of the problem.

The elevation and azimuthal LOS angles with this adaptive IRU correction system show amazingly close agreement to the true LOS angles. With no IRU correction loop the results degrade rapidly after missile turndown and nullify some of the advantages of the filter.

The target velocity and position estimation errors due to IRU degradation alone are shown in FIG. 9 starting with perfect initial target information. A curve corresponding to the case without the IRU correction is also shown. The lateral components are too close to be shown here. The downrange target velocity and position component errors increase very rapidly after zero crossing at around 100 and 120 sec, respectively, in case of no IRU correction loop. With the IRU correction loop gain equal to one, a response time of about 60 sec is achieved with RMS error about 1 nmi, except for the last 30 sec of flight during which it increases gradually to around 2 nmi. The interesting behavior is about the discrepancy parameter $\Delta\hat{X}_V$. Without applying the IRU correction loop it grows linearly out of bonds before turndown while the adaptive correction loop brings $\Delta\hat{X}_V$ under control with the accumulated correction factor $\Delta\hat{Z}_m$ against the limiter. If the limiting condition is relaxed, $\Delta X_V$ can be brought down to oscillate around zero with oscillation frequency determined by the correction loop gains $G_Y$ and $G_Z$.

When the initialization errors are included, the results are substantially the same. There may be an early overcorrection to the limiter, but this adaptive correction scheme realizes the mistake and then takes the proper direction. The altitude is substantially corrected well ahead of intercept. Even with the initialization errors the reconstructed azimuthal and elevation angles are very close to the true values to within a fraction of a degree.

Target velocity estimation errors are corrected in much the same way. The FIG. 8 curve with the hump is representative of IRU mis-correction resulting in a large value for $\Delta X_V$ and the IRU correction loop misinterprets it as caused by negative misalignment angle $A_{oz}$. Because of the limiter, the over-correction problem is soon realized and the correction reverses to level off the discrepancy parameter.

For the above reasons, to avoid the confusion due to the large transient, the correction loop will normally be set to take effect after half of the missile flight, or at about 120 seconds. In the first half of the flight, the missile suffers the uncorrected IRU error. At about the halfway point, the adaptive correction loop takes over.

The $\hat{A}_{oy}$ and $\hat{A}_{oz}$ angles remain zero for the first 120 seconds to avoid accumulating the wrong information due to the induced discrepancy. Later, they quickly respond to the IRU problem and correct IRU errors in both planes in the right direction.

It should now be apparent how the present IRU correction loop performs its function to identify IRU errors and construct correction terms to recover the missile true position to obtain smoothed LOS angle estimates. It is likely that changes and modifications will occur to those skilled in the art which are within the scope of the accompanying claims.

What is claimed is:

1. A target state estimation system in a missile for multi-mode guidance of said missile where measured range and range rate information and unavailable, wherein a missile launching platform having an established inertial frame of reference senses target radiation in the form of electromagnetic signals transmitted by a target, generates corresponding missile launching platform target line-of-sight (LOS) data referenced to said missile launching platform inertial frame of reference, and communicates said missile launching platform target LOS data to said missile, said missile target state estimator system comprising:

sensor means onboard said missile for sensing said target radiation and, in response thereto, for generating missile target LOS data;

inertial reference unit (IRU) means onboard said missile for establishing a missile coordinate frame of reference for said missile and for generating IRU missile state information with respect to said missile coordinate frame of reference;

a central control system onboard said missile connected to said sensor means and said IRU means, said central control system comprising Kalman filter means for receiving missile launching platform target LOS data, missile target LOS data and IRU missile state information for generating updated target state data based upon estimations of target state from previous missile launching platform target LOS data, missile target LOS data and IRU missile state information, updated subsequent missile launching platform target LOS data, missile target LOS data and IRU missile state information so as to provide estimates of current target state data corresponding to target acceleration, velocity, position, range-to-go, and reconstructed azimuth and elevation LOS angles, wherein said Kalman filter means comprises a multi-state horizontal filter and a multi-state vertical filter each kinematically modeled for expected target characteristics, said horizontal filter having a kinematic target model of a horizontal plane multi-state vector with one state of said horizontal plane multi-state vector defining a first range estimate discrepancy parameter and said vertical filter having a kinematic target model of a vertical plane multi-state vector with one state of said vertical multi-state vector defining a second range estimate discrepancy parameter, said horizontal and vertical filters coupled for crosstalk between said first and second range estimate discrepancy parameters; and IRU adaptive correction means onboard said missile, connected between said central control system and said IRU means, and responsive to at least one input correction factor, with each input correction factor corresponding to a respective one of said first and second range estimate discrepancy parameters, and at least one corresponding geometry factor from said central control system, for generating a corresponding alignment correction factor which is provided to said IRU means, wherein said IRU means in response to said alignment correction factor provides corrected IRU missile state information to said Kalman filter means so as to correct unmodeled errors in said missile coordinate frame of reference and align said missile coordinate frame of reference with said missile launching platform inertial frame of reference.

2. The target state estimation system of claim 1 wherein said missile launching platform is a ship having a reference location and defining said missile launching platform inertial frame of reference; and wherein said IRU means established missile coordinate frame of reference is initially aligned with respect to said missile launching platform inertial frame of reference, to which the missile launching platform LOS data are related.

3. The target state estimation system of claim 2 further comprising:

means on said missile launching platform for determining missile launching platform azimuth and elevation target LOS data with respect to said target;

means for uplinking said missile launching platform target LOS data from said missile launching platform to said missile; and wherein said uplinked missile launching platform target LOS data is employed by said central control system for target state estimation.

4. The target state estimation system of claim 2 further comprising:

a third party aircraft;

means on said aircraft for determining aircraft target LOS data with respect to said target;

means for uplinking said aircraft target LOS data from said aircraft to said missile; and wherein said uplinked aircraft target LOS data is employed by said central control system for target state estimation.

5. The target state estimation system of claim 2 further comprising:

a third party aircraft;

means on said aircraft for determining aircraft target LOS data with respect to said target;

means for coupling said aircraft target LOS data to said missile launching platform;

means for uplinking said aircraft target LOS data from said missile launching platform to said missile, said aircraft target LOS data being referenced with respect to said missile launching platform; and wherein said uplinked aircraft LOS data is employed by said central control system for target state estimation.

6. The target state estimation system of claim 1 wherein said horizontal filter has seven states and said vertical filter has four states.

7. A method for target state estimation by a missile for multi-mode guidance of said missile where measured range and range rate information are unavailable, wherein a missile launching platform provides missile launching platform target line-of-sight (LOS) data referenced to an established missile launching platform inertial frame of reference, said method comprising the steps of:

sensing target radiations in the form of electromagnetic signals transmitted by a target by sensor means onboard said missile;

generating missile target LOS data from said sensed target radiations;

receiving onboard said missile, missile launching platform target LOS data;

providing a missile coordinate frame of reference onboard said missile from an inertial reference unit (IRU);

generating in said IRU, IRU missile state information with respect to said missile coordinate frame of reference;

providing a kinematic target model of a horizontal plane multi-state vector in a horizontal multi-state recursive Kalman-type filter wherein one of said horizontal plane vector states defines a first range estimate discrepancy parameter;

providing a kinematic target model of a vertical plane multi-state vector in a vertical multi-state recursive Kalman-type filter wherein one of said vertical plane vector states defines a second range estimate discrepancy parameter;

coupling said horizontal and said vertical filters together by crosstalking said first and second range estimate discrepancy parameters;

coupling said missile launching platform target LOS data and said missile target LOS data to said horizontal and vertical Kalman-type filters;

providing at least one input correction factor, each input correction factor corresponding to a respective one of said first and second range estimate discrepancy parameters, from said horizontal and vertical Kalman-type filters to an adaptive correction means;

providing at least one geometry factor, each corresponding to a respective one of said input correction factors, from said horizontal and vertical Kalman-type filters to said adaptive correction means;

generating at least one alignment correction factor, each alignment correction factor corresponding to corresponding input correction factors and geometry factors;

providing corrected IRU missile state information from said IRU means, in response to each alignment correction factor, to said horizontal and vertical Kalman-type filters so as to correct unmodeled errors in said missile coordinate frame of reference and align said missile coordinate frame of reference with said missile launching platform inertial frame of reference;

recursively providing, in said horizontal and vertical Kalman-type filters, updated target state data based on estimations of target state from previous missile launching platform target LOS data, missile target LOS data and IRU missile state information updated by subsequent missile launching platform target LOS data, missile target LOS data and IRU missile state information; and providing estimates of target acceleration, velocity, position, range-to-go and reconstructed LOS angles for both azimuth and elevation angles, from said updated target state data.

8. The method of claim 7 further comprising the step of:

providing said missile launching platform in the form of a ship having a reference location and defining said missile launching platform inertial frame of reference, wherein said missile coordinate frame of reference is initially aligned with respect to said missile launching platform inertial frame of reference.

9. The method of claim 8 further comprising the steps of:

determining, on said missile launching platform, missile launching platform azimuth and elevation target LOS data; and uplinking said missile launching platform target LOS data from said missile launching platform to said missile.

10. The method of claim 8 further comprising the steps of:

providing an aircraft;

determining, in said aircraft, aircraft target LOS data with respect to said target; and uplinking said aircraft target LOS data from said aircraft to said missile, wherein said missile uses said aircraft target LOS data with said missile launching platform target LOS data for generating estimates of current target state data.

11. The method of claim 8 further comprising the steps of:

providing an aircraft;

determining, in said aircraft, aircraft target LOS data with respect to said target;

coupling said aircraft target LOS data to said missile launching platform;

uplinking said aircraft target LOS data from said missile launching platform to said missile, wherein said uplinked aircraft LOS data is referenced with respect to said missile launching platform and wherein said missile uses said aircraft target LOS data with said missile launching platform target LOS data for generating estimates of current target state data.

* * * * *